United States Patent [19]

Brisebarre

[11] 4,369,960

[45] Jan. 25, 1983

[54] DEVICE FOR SEPARATING BANK NOTES

[75] Inventor: Marcel Brisebarre, Thoiry, France

[73] Assignee: ATS Advanced Technics & Systems, S.A., Lausanne, Switzerland

[21] Appl. No.: 198,797

[22] Filed: Oct. 20, 1980

[30] Foreign Application Priority Data

Nov. 1, 1979 [CH] Switzerland ..... 9821/79

[51] Int. Cl.[3] ..... B65H 3/14

[52] U.S. Cl. ..... 271/5; 271/20; 271/30 A; 271/97

[58] Field of Search ..... 271/5, 97, 98, 30 A, 271/20

[56] References Cited

U.S. PATENT DOCUMENTS

| | | | |
|---|---|---|---|
| 1,888,194 | 11/1932 | Broadmeyer | 271/98 |
| 3,770,266 | 11/1973 | Wehr | 271/97 |
| 3,785,638 | 1/1974 | Beazley | 271/97 X |
| 4,270,746 | 6/1981 | Hamlin | 271/98 |

FOREIGN PATENT DOCUMENTS

| | | | |
|---|---|---|---|
| 764296 | 8/1967 | Canada | 271/97 |

*Primary Examiner*—Richard A. Schacher

*Attorney, Agent, or Firm*—Eugene E. Geoffrey, Jr.

[57] ABSTRACT

A case (1) comprises a pile of bank notes (2). An air supply circuit (13, 14, 15) forms a jet of air (16) in the vicinity of an edge of the first note (2*a*).

In order to separate the note (2*a*) from its pile (2) in a simple manner, a succession of states of pressure and of reduced pressure is created downstream of the edge (d) of the opening (17). The interruption in profile creates a reduced pressure over the face of the note (2*a*) in the vicinity of this opening (17). The edge of the note is then raised and enters the jet of air (16). A change of state occurs and a pressure applies the note (2*a*) against the moving rollers (5) while holding the following note applied against the pile (2).

12 Claims, 12 Drawing Figures

DEVICE FOR SEPARATING BANK NOTES

Figure 1:
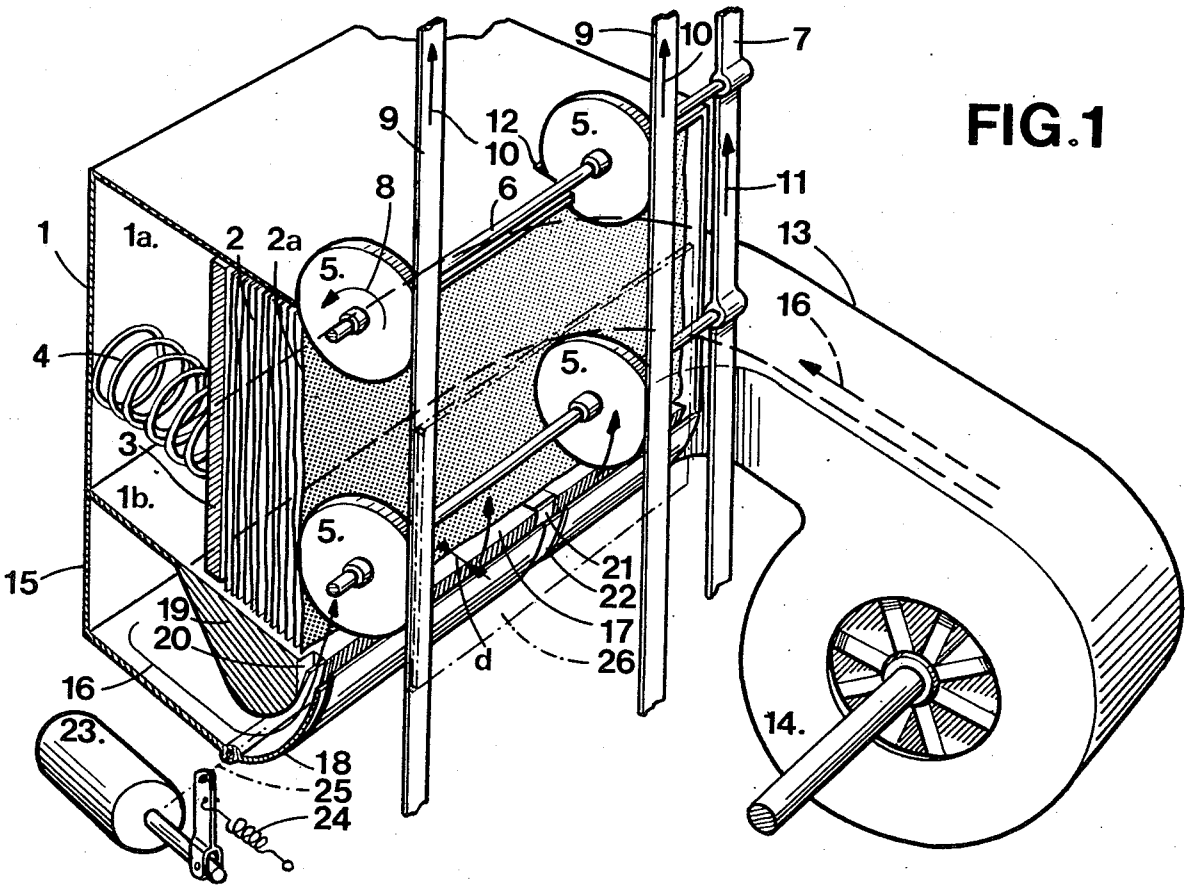

The invention relates to a device enabling bank notes to be separated and extracted one by one from a pile or from a bundle.

Devices of this type exist such as those described in the U.S. Pat. Nos. 3,954,260 or 3,877,695 which use movable members in which there are incorporated suction means which enable the first note of a pile to be sucked up. These arrangements are complicated because it is necessary to create a reduced pressure phenomenon in the heart of a movable member, this movable member being adapted to entrain the notes sucked up and thus fixed, by itself or in association with accessory means such as belts. This complexity of construction leads to a high cost price of the machine which comprises such a device.

Other known devices, such as those described in the U.S. Pat. Nos. 1,888,194 or 3,504,910, use, on the one hand, means for blowing laterally on the pile of notes in order to separate them and, on the other hand, means such as a movable roller or another blowing device to carry these notes away from the pile. There, too, the pneumatic means used are complex and lead to a high cost price.

On the other hand, in the U.S. Pat. No. 4,095,781, both blowing means and suction means are used, disposed in a movable member. As a result, the complexity is further increased.

Finally, in the U.S. Pat. No. 3,993,301, a plurality of movable heads sucks up the note under the effect of a reduced pressure created by a jet of air under pressure. This device likewise has a complex construction likewise associated with the incorporation of pneumatic means in movable members.

It is therefore found that as a whole the separation of the notes is effected by reduced pressure applied at points and by hollow air-tight movable members which transmit said reduced pressure and carry the notes away according to their movement.

As for the blowing means, they are only auxiliary devices intended for the preliminary separation of the notes, preparing and facilitating the grasping of the first by another member (friction roller, suction heads, as mentioned above).

As explained, complex and expensive devices result.

The object of the present invention is to provide a device for the separation of bank notes which is simple in construction and therefore inexpensive in comparison with the previous devices.

In order to do this, the device comprises a single fixed member effecting a succession of pressures and reduced pressures permitting an easy separation of a note from its pile.

Figure 6:
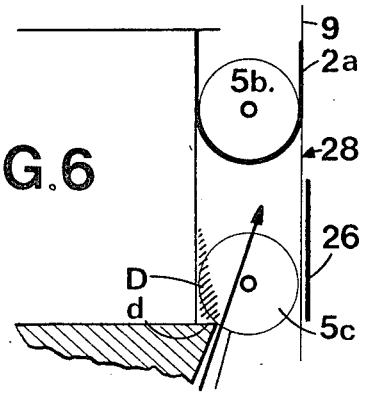
Figure 7:
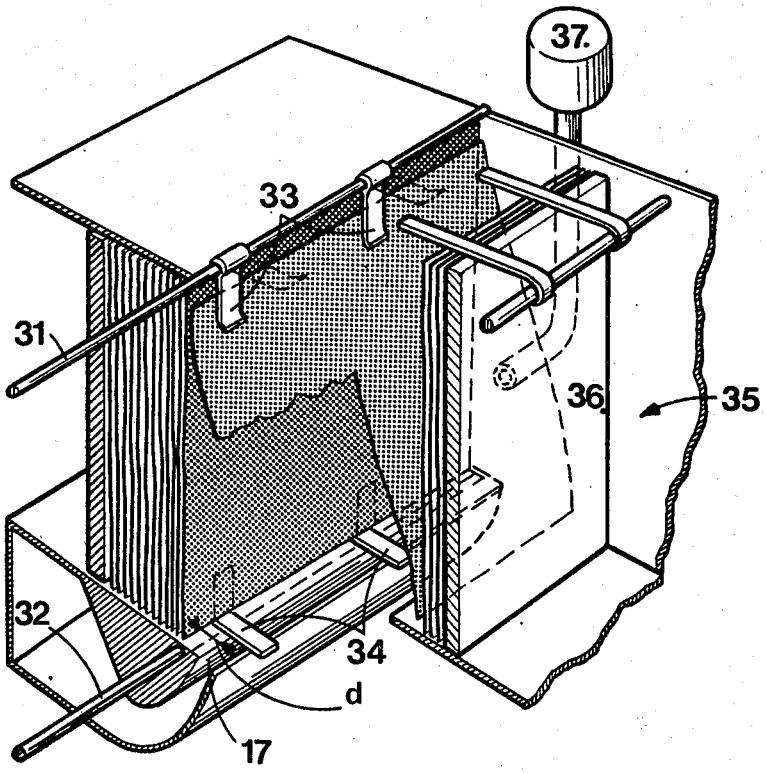

The description will be better understood by means of the drawing illustrating forms of embodiment of the invention given by way of example and in which:

FIG. 1 represents in a perspective view and in section a first form of embodiment of the invention, FIGS. 2 to 6 illustrate the different phases of operation of the device of FIG. 1, FIG. 7 represents in a perspective view and in section a second form of embodiment of the device according to the invention, and FIGS. 8 to 12 illustrate the different phases of operation of the device of FIG. 7.

In the form of embodiment of FIG. 1, a case 1 contains bank notes 2 in the form of a pile pressed towards the open portion of the case 1 by means of springs 4 bearing on a plate 3. The top 1*a* of the case 1, its open portion and the surface of the plate 3 have a shape substantially equal to the surface of a bank note 2 so that the pile can easily slide while being held. Rhytmic means, here represented by displaced rollers 5, hold the pile of notes 2 in such a manner that the first note 2*a* is always close to the open portion of the case 1.

More precisely, the top of the pile represented by the first note 2*a* is held in the plane tangent to the rollers 5 opposite that formed by the belts 9. These rollers 5 are mounted on a plurality of spindles 6, the spacing of which is defined by belts 7 only one of which is illustrated here, carrying these spindles 6 at regular intervals. Only two rollers 5 per spindle 6 are illustrated although each spindle 6 may carry a greater number thereof. Similarly, only two spindles 6 are illustrated although in reality a whole series of such spindles 6 carrying rollers 5 passes in front of the case 1 at regular intervals. The rollers 5 rotate on themselves in the direction of the arrow 8, rolling on the one hand on the drive belts 9 and on the other hand on the notes. Thus, in our example, the belts 7 travel in the direction defined by the arrow 11 at a speed half the speed of travel of the belts 9 defined by the arrow 10.

An air-conveying passage 13 brings air under pressure from a blower 14 to a chamber 15 coupled to the case 1. This blower 14 may consist simply of a fan surrounded by a casing channeling the air. The air under pressure is directed in accordance with the arrows 16 through the chamber 15 to an opening 17 in the form of a slot extending over the whole width of the case 1. In order to do this, the chamber ends in a rounded flap 18 which, cooperating with another rounded element 19, progressively forms the opening in the form of a slot 17.

We have seen that as a result of the arrangement of the rollers 5 and of the belts 7 and 9, the top of the pile represented by the note 2*a* always remains at a constant level. The opening 17 in the form of a rectangular slot is situated at a distance d from the note 2*a*.

In other words, the portion 19 of the chambers 15 leaves an edge of a width d in relation to the surface of the note 2*a* in the plane 1*b* of the case 1 and by cooperating with the rounded element 19 forms the opening 17 and produces a laminar jet of air in the direction of travel of the rollers 5, diverging slightly in relation to the surface of the note 2*a*, the jet of air being subjected to a sudden break in profile downstream of the edge d.

At the places where the rollers 5 pass, the part 19, passing beyond the top of the pile by d, is provided with notches 20. They permit the free passage of the rollers 5 at a height corresponding to the surface of the top of the pile. Tongues 21 resiliently connected to the part 19 are lowered at each passage and resume a position according to the external surface of said part 19. The rounded flap 18 likewise comprises resilient tongues 22 adapted to be lowered on the passage of the rollers 5.

Moreover, the actuation of a relay 23 enables the rounded portion 18 to be acted upon with the object of closing the opening 17 in the form of a slot.

In this form of embodiment, when the relay 23 is released, the spring 24 relaxes and folds down the rounded portion 18 by pivoting about the pin 25 on the element 19, thus cutting off the jet of air.

A screen 26 enables the running of the device to be improved by causing the pressure operation and the reduced pressure operation to alternate more distinctly, as will be described hereinafter.

FIGS. 2 to 6 describe diagrammatically the phases of separation of a bank note by means of the device described.

Figure 2:
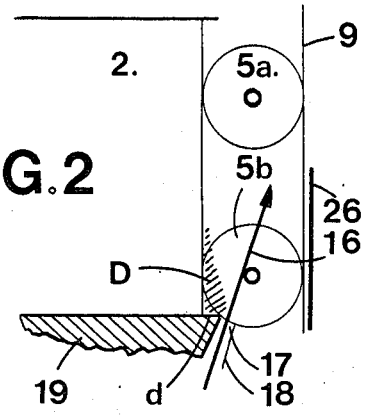

FIG. 2 illustrates the pile 2 held by the rollers 5*a* and 5*b* and by the belt 9. At a distance d from the pile 2, through the opening 17, the jet of air 16 is applied, diverging slightly in relation to the surface of the pile 2. The successive rollers, of which only the rollers 5*a* and 5*b* are illustrated, do not prevent the passage of the jet of air 16 over the whole width of the opening 17. This is clear from FIG. 1.

In a first phase, when the roller 5*b* has passed in front of the opening 17, the jet of air 16 creates a reduced pressure D downstream of this opening 17, in accordance with a well known principle. In order that this reduced pressure D may be effective, it is necessary for the profile of the opening 17 to be regular and for the parts 18 and 19 to guarantee a satisfactory sealing. In order to do this, as already explained, tongues 21 and 22 have been provided which resiliently resume their initial position after the passage of the rollers 5.

Figure 3:
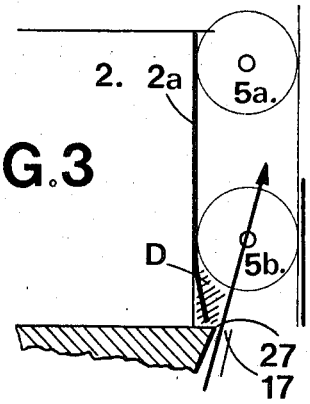
Figure 4:
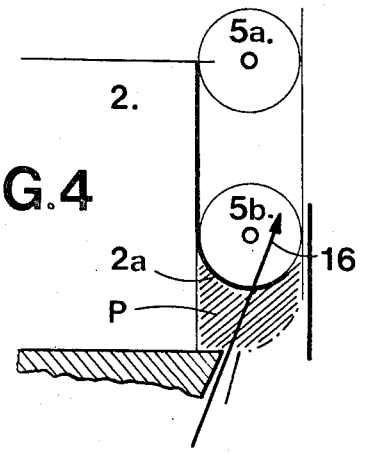
Figure 5:
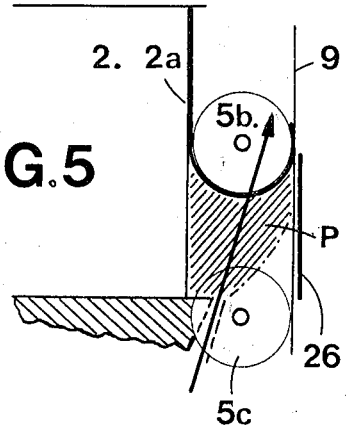

FIG. 3 illustrates how the first note 2*a* of the pile 2 becomes detached under the effect of the reduced pressure D when the roller 5*b* continues its displacement. As soon as the edge of the note 2*a* passes in front of the edge 27 of the opening 17, a change of state occurs; see FIG. 4. The reduced pressure D is changed into the pressure P and the jet of air 16 applies the note 2*a* against the roller 5*b* while maintaining the following note against the pile 2. Then (see FIG. 5), while maintaining the pressure effect P, the roller 5*b*, cooperating with the belt 9, grips the note 2*a* which is thus lifted from the pile 2. The upper edge of the screen 26 is held at such a height that the pressure effect P is maintained until the roller 5*b* passes this upper edge. This position coincides with the arrival of a fresh roller 5*c* in position to take the following note. FIG. 6 shows that as soon as the roller 5*b* leaves a sufficient opening 28 between the plate 26 and itself to release the pressure P, a fresh reduced pressure D becomes established in the vicinity of the edge d while the roller 5*c* is in a position to take the following note. As for the roller 5*b*, it transmits the note 2*a* to the belt 9 which conveys it to a storage or distribution device not illustrated. The plate 26 is not necessary; it is merely useful to improve the quality of the passage from the pressure P to the reduced pressure D.

In order to stop the process of removal of the notes, it is sufficient to act on the relay 23 which closes the opening 17 and thus cuts off the jet of air 16.

In the second form of embodiment illustrated in FIG. 7, the air circuit is the same except that the flap 18 is fixed because the stoppage of the jet is no longer necessary to stop the distribution of the notes. The elements identical to those of FIG. 1 bear the same reference symbols.

The rhytmic means are represented this time by an upper spindle 31 and a lower spindle 32 respectively carrying fingers 33 and 34. These spindles are movable and bring the fingers 33 and 34 into the open or closed position as indicated either in black lines or in chain lines. The fingers 33 and 34 hold the notes at the distance d from the opening 17 of the air supply circuit. A receiving device 35 for the notes comprises a plate 36 which may be fixed to receive small wads of notes or movable to receive larger bundles, the plate 36 then being held by a spring of appropriate shape. A pressure pick-off 37 enables the passage of each note to be detected and then to be counted.

FIGS. 8 to 12 indicate the phases of separation of a note from the pile 2.

Figure 8:
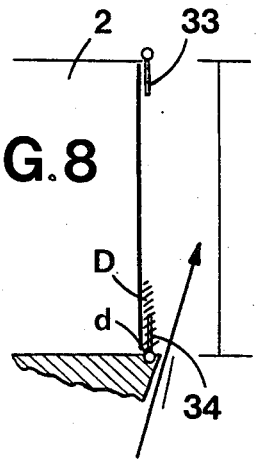
Figure 9:
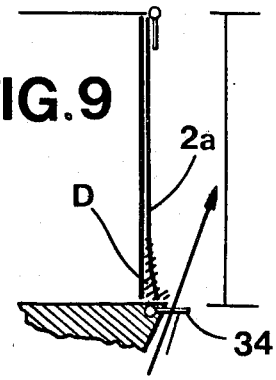
Figure 10:
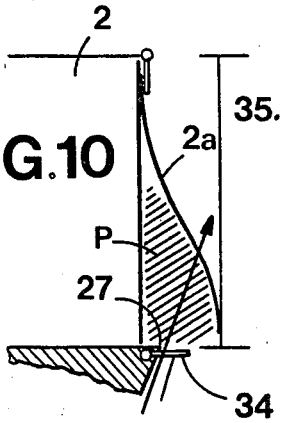
Figure 11:
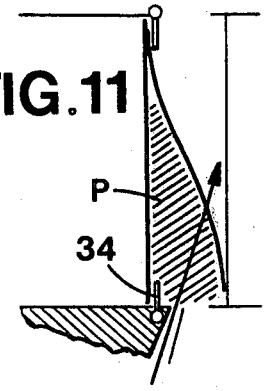
Figure 12:
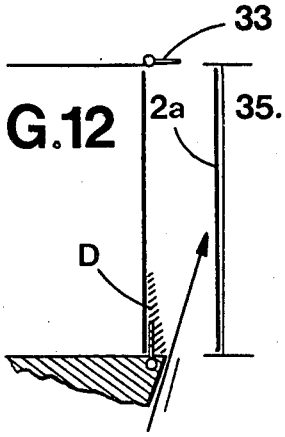

FIG. 8 shows the fingers 33 and 34 in the closed position. The reduced pressure D created downstream of d cannot act. In FIG. 9, the lower finger 34 has been opened and the first note 2*a* begins to become detached. In FIG. 10, with the finger 34 still open, the note 2*a* has passed in front of the edge 27 and is applied by pressure P against the receiving device 35, while the following note is pressed and held against the pile 2. At this moment, the finger 34 is replaced in the closed position as FIG. 11 indicates. Finally, in order to ensure the passage towards the receiving device 35 (see FIG. 12), the finger 33 is opened, the pressure P is released by the application of the note 2*a* in the receiving device 35 and the reduced pressure D is again created. The finger 33 is again closed and the initial position of FIG. 8 is resumed, ready for the detachment of a fresh note. When it is desired to stop the removal of the notes, it is sufficient to keep the fingers 33 and 34 closed.

It is possible to provide a series of such separation devices in such a manner as to form a note distributor. In such a case, each device would be dimensioned according to the size of the corresponding note. In the form of embodiment of FIG. 1, the rollers 5 would be used for each of the separation devices. Means permitting the counting and the checking of the evacuation of the notes may be incorporated. Such means are known to those skilled in the art and it is not necessary to describe them here.

I claim:

1. A device for separating bank notes from a pile having an outermost note defining a plane comprising at least one air jet disposed adjoining one edge of said outermost note and in spaced relationship to the side of said plane away from said pile and directing the air emanating therefrom in a diverging direction in relation to the plane of said outermost note to produce a reduced pressure, in a first phase, on the front face of the last said note which removes an edge portion thereof until this edge enters said jet, whereby said jet may act, in a second phase, by pressure on the opposite face of the note to detach it from the pile and simultaneously to hold the following note applied against said pile.

2. A device as claimed in claim 1, characterized in that it comprises temporary holding means holding at least the opposite edge of the note applied against the pile during the first phase, then, during the second phase, on the one hand releasing this opposite edge to permit the complete detachment of the note and on the other hand holding the edge of the following note applied against the pile.

3. A device as claimed in claim 2, characterized in that said temporary holding means consist of successive rollers, regularly spaced and driven by a belt.

4. A device as claimed in claim 2, characterized in that said temporary holding means comprise a lower spindle, and fingers carried by said lower spindle for successively holding and releasing the edge of the note subjected to reduced pressure, and of an upper spindle, and fingers carried by said upper spindle for successively holding and releasing the opposite edge of the note.

5. A device for separating relatively thin sheets from a pile comprising means having at least one open end for supporting said pile with the outermost sheet adjoining said open end and defining a plane, at least one air jet disposed adjoining one edge of said outermost sheet and in spaced relationship to the side of said plane away from said pile and directing the air emanating therefrom in a direction diverging directionally away from said outermost sheet of said pile whereby the stream of air flowing divergently of said outermost sheet creates during a first phase a zone of reduced pressure adjoining the last said sheet causing the edge thereof to enter said stream and remove it from the pile and during a second phase producing a pressure between the facing sides of the partially removed outermost sheet and the next successive sheet to hold the latter in position on the pile during at least a portion of the time required for removal of the outermost sheet, and means displacing said pile toward said open end to bring each successive sheet in order to a position adjoining said open end.

6. A device according to claim 5 wherein said sheets are bank notes.

7. A device for separating relatively thin sheets from a pile comprising means having at least one open end for supporting said pile with the outermost sheet adjoining said open end, at least one air jet disposed at one edge of said open end and spaced outwardly from the outermost sheet to direct the air emanating from said jet in a direction diverging from the plane of said sheet whereby the stream of air flowing divergently of said outermost sheet creates during a first phase a zone of reduced pressure adjoining the last said sheet causing the edge thereof to enter said stream and remove it from the pile and during a second phase producing a pressure between the facing sides of the partially removed outermost sheet and the next successive sheet to hold the latter in position on the pile during at least a portion of the time required for removal of the outermost sheet, and means displacing said pile toward said open end to bring each successive sheet in order to a position adjoining said open end, holding means adjoining an edge of said pile displaced from said edge adjoining said air jet to hold said outermost sheet in position on said pile and means periodically operating said holding means to release said outermost sheet and then engage the next successive sheet to retain it on said pile.

8. A device according to claim 7 wherein said holding means comprises at least one roller carrying belt, means for moving said belt in a plane substantially parallel to the plane of said outermost sheet and in the direction of said air flow and a plurality of spaced rollers carried by said belt, the spacing between successive rollers being less than the length of said sheet in the direction of movement of said rollers.

9. A device according to claim 8 including at least one sheet receiving belt movable in the direction of the first said belt and positioned on the side of said rollers away from said pile, said second belt being aligned with said rollers and functions in combination with said rollers to transport each sheet as it is removed from said pile.

10. A device according to claim 9 wherein at least two spaced roller carrying belts are provided for carrying said rollers, said rollers are arranged in spaced sets of at least two axially aligned spaced rollers and at least two spaced sheet receiving belts with the last said belts being aligned with said sets of rollers.

11. A device according to claim 7 wherein said holding means includes finger-like tabs pivoted to said structure at spaced points about the edges of said outermost sheet and means for periodically pivoting said tabs from one position against said outermost sheet to another position away from the last said sheet to permit the release thereof.

12. A device according to claim 11 wherein one set of at least two tabs is placed along the edge of said open end adjoining said air jet and another set of at least two tabs is placed along an edge of said pile opposing the last said edge and means for individually moving said sets of tabs repeatedly between said positions to first release the edge of said outermost sheet adjoining said air jet and upon displacement of a portion of said sheet releasing the opposing edge of said sheet and holding first the edge of the successive sheet adjoining the air jet and then upon displacement of the entire outermost sheet holding the opposing edge of said successive sheet.

* * * * *